US010870275B2

(12) United States Patent
Ito et al.

(10) Patent No.: US 10,870,275 B2
(45) **Date of Patent: *Dec. 22, 2020**

(54) LIQUID DISCHARGE HEAD AND METHOD OF PRODUCING LIQUID DISCHARGE HEAD

(71) Applicant: Brother Kogyo Kabushiki Kaisha, Nagoya (JP)

(72) Inventors: Yuichi Ito, Mie-gun (JP); Toru Kakiuchi, Chita-gun (JP); Yasuo Kato, Chita-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/930,378

(22) Filed: Jul. 16, 2020

(65) Prior Publication Data

US 2020/0346456 A1 Nov. 5, 2020

Related U.S. Application Data

(63) Continuation of application No. 16/211,413, filed on Dec. 6, 2018, now Pat. No. 10,744,766.

(30) Foreign Application Priority Data

Feb. 28, 2018 (JP) ..... 2018-035008

(51) Int. Cl.
*B41J 2/14* (2006.01)
*B41J 2/16* (2006.01)

(52) U.S. Cl.
CPC ..... *B41J 2/14201* (2013.01); *B41J 2/14233* (2013.01); *B41J 2/161* (2013.01);
(Continued)

(58) Field of Classification Search
CPC ..... B41J 2/14201; B41J 2/14233; B41J 2/14209; B41J 2002/14217; B41J 2002/1425; B41J 2/161; B41J 2002/14241
See application file for complete search history.

(56) References Cited

U.S. PATENT DOCUMENTS 10,744,766 B2 * 8/2020 Ito ..... B41J 2/161
2016/0221337 A1 8/2016 Sugiura et al.
(Continued)

FOREIGN PATENT DOCUMENTS

JP 2017-124540 A 7/2017

*Primary Examiner* — Kristal Feggins
(74) *Attorney, Agent, or Firm* — Banner & Witcoff, Ltd.

(57) ABSTRACT

There is provided a liquid discharge head including: a channel substrate including a pressure chamber; a support substrate having a through hole; a piezoelectric element disposed between the channel substrate and the support substrate in a thickness direction of the channel substrate; a drive section disposed on a surface of the support substrate on a side opposite to the piezoelectric element; a trace passing through the through hole of the support substrate, extending on the support substrate toward the drive section, and connected to the piezoelectric element and the drive section; and a reservoir member including a channel communicating with the pressure chamber, and joined to the surface of the support substrate with adhesive. A protrusion or a recess is provided on the surface of the support substrate on the side opposite to the piezoelectric element at a position between the trace and the channel.

12 Claims, 10 Drawing Sheets

(52) U.S. Cl.
CPC ..... *B41J 2/1623* (2013.01); *B41J 2/1628* (2013.01); *B41J 2/1629* (2013.01); *B41J 2/1632* (2013.01); *B41J 2/1634* (2013.01); *B41J 2002/14241* (2013.01); *B41J 2002/14362* (2013.01); *B41J 2002/14419* (2013.01)

(56) References Cited

U.S. PATENT DOCUMENTS

| | | | |
|---|---|---|---|
| 2017/0217174 | A1 | 8/2017 | Tanaka et al. |
| 2017/0334206 | A1 | 11/2017 | Hayashi et al. |

* cited by examiner

LIQUID DISCHARGE HEAD AND METHOD OF PRODUCING LIQUID DISCHARGE HEAD

CROSS REFERENCE TO RELATED APPLICATION

This application is a Continuation of U.S. application Ser. No. 16/211,413, filed on Dec. 6, 2018, which claims priority from Japanese Patent Application No. 2018-035008 filed on Feb. 28, 2018, the disclosures of which are incorporated herein by reference in their entirety.

BACKGROUND

Field of the Invention

The present disclosure relates to a liquid discharge head and a method of producing the liquid discharge head.

Description of the Related Art

There is known, for example, a liquid discharge head as a liquid discharge apparatus using a conventional head. In the known liquid discharge head, a nozzle plate including nozzle openings, a communicating plate including nozzle communicating paths that communicate with the nozzle openings, and a channel forming substrate including pressure chambers that communicate with the nozzle communicating paths are stacked on top of each other. A piezoelectric actuator that generates a pressure change in ink in each pressure chamber is provided on a vibration plate of the channel forming substrate. A drive circuit substrate is joined to a surface (first main surface) of the channel forming substrate on which the piezoelectric actuator is placed, and a drive circuit configured to output a signal for driving the piezoelectric actuator is mounted on a surface of the drive circuit substrate on the side opposite to the channel forming substrate.

A first through hole passes through the drive circuit substrate. A first through trace connected to the piezoelectric actuator passes through the first through hole. A first individual trace is provided on the first main surface of the drive circuit. The first individual trace is connected to the drive circuit and the first through trace.

A case including a manifold that communicates with the pressure chambers is secured to a joined body formed from the channel forming substrate, the drive circuit substrate, the communicating plate, and the nozzle plate. The channel forming substrate and the drive circuit substrate are accommodated in a recess of the case.

SUMMARY

In the above liquid discharge head, the first individual trace is provided on the first main surface of the channel forming substrate. The first main surface of the channel forming substrate faces a surface (opposite surface) defining the recess of the case. In that configuration, for example, if adhesive is used for the first main surface and the opposite surface to join the channel forming substrate and the case, the adhesive may flow on the first main surface toward the first individual trace. This may cause adhesion of the adhesive to the first individual trace.

The adhesive has a linear expansion coefficient that is different from that of the first individual trace. When the adhesive and the first individual trace are heated due to heat generation in the drive circuit, the piezoelectric actuator, and the like, stress generated by the difference in the linear expansion coefficients may break or disconnect the first individual trace. Further, the adhesive may contract or shrink during adhesive setting, which may cause disconnection of the first individual trace due to stress generated by the adhesive contract.

The present disclosure has been made in order to solve the above problems, and an object of the present disclosure is to provide a head capable of reducing the possibility of breaking or disconnecting a trace, and a method of producing the head.

According to an aspect of the present disclosure, there is provided a liquid discharge head, including a channel substrate including a pressure chamber; a support substrate including a through hole; a piezoelectric element disposed between the channel substrate and the support substrate in a thickness direction of the channel substrate to overlap with the pressure chamber in the thickness direction; a drive section disposed on an opposite surface of the support substrate and configured to drive the piezoelectric element, the opposite surface of the support substrate being opposite to the piezoelectric element; a trace passing through the through hole of the support substrate, extending on the support substrate toward the drive section, and connected to the piezoelectric element and the drive section; and a reservoir member including a channel which communicates with the pressure chamber, and joined to the opposite surface of the support substrate with adhesive. One of a protrusion and a recess is provided on the opposite surface of the support substrate at a position between the trace and the channel.

In the above configuration, at least one of the protrusion and the recess can inhibit the adhesive from spilling out into the trace. This inhibits adhesion of the adhesive to the trace. Accordingly, the trace is not subjected to stress which may otherwise be caused by a difference in linear expansion coefficients between the adhesive and the trace, thus inhibiting disconnection of the trace due to the stress.

DESCRIPTION OF THE EMBODIMENTS

First Embodiment

<Liquid Discharge Apparatus>

Figure 1:
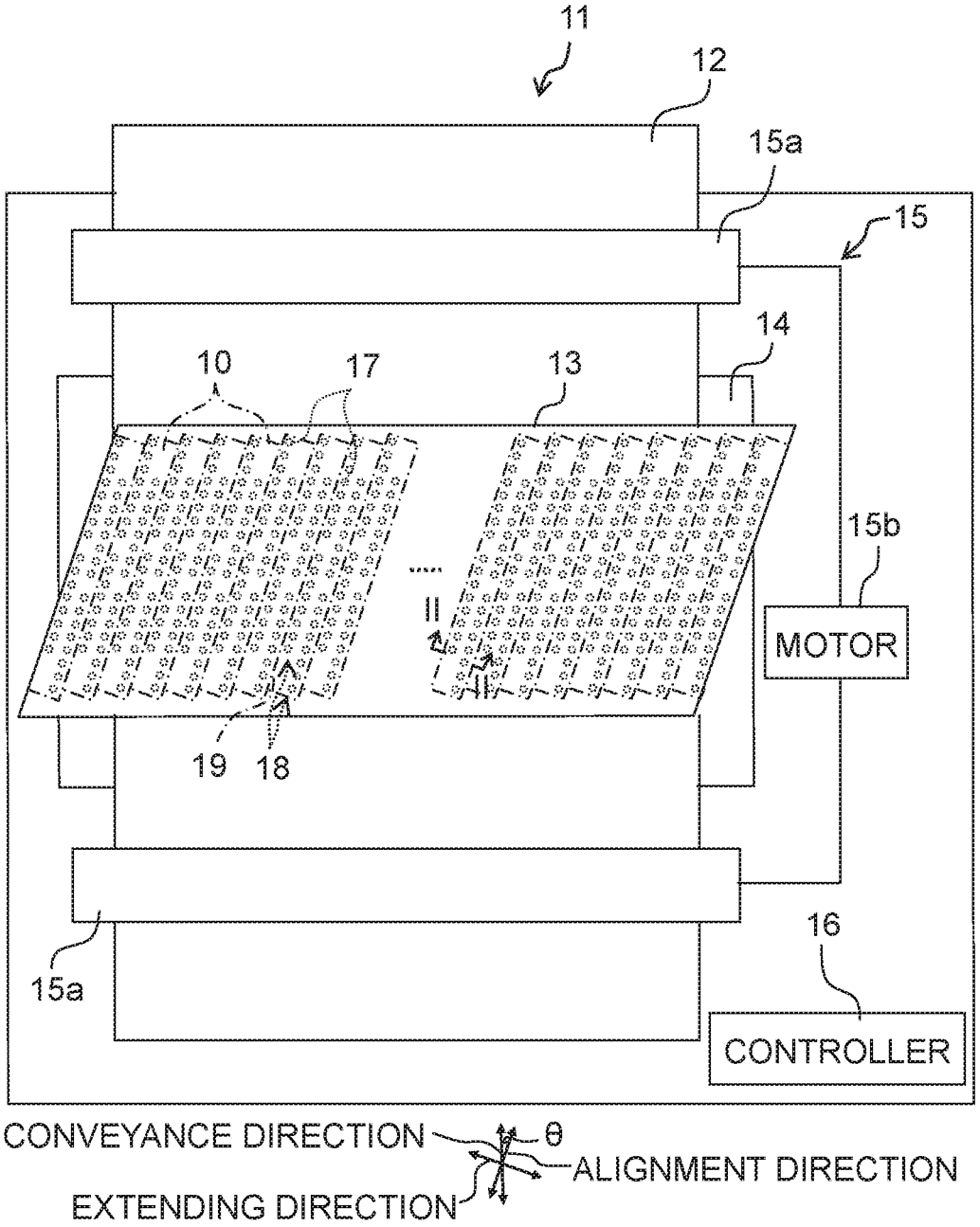
FIG. 1 schematically depicts a head according to the first embodiment.

A liquid discharge apparatus 11 using a head 10 according to the first embodiment of the present disclosure is, for example, a printer that performs printing on a recording medium 12 such as paper by use of a liquid such as ink, by jetting the liquid while conveying the recording medium 12, as depicted in FIG. 1. In the following, although the liquid discharge apparatus 11 is explained as an apparatus using the head 10, the apparatus using the head 10, however, is not limited thereto. Further, in the following, although the printer is explained as the liquid discharge apparatus 11, the liquid discharge apparatus 11 may be any other apparatus that discharges liquid.

The liquid discharge apparatus 11 includes a head unit 13, a platen 14, a conveyance mechanism 15, and a controller 16. The head unit 13 includes a plurality of heads 10, which are arranged in a direction orthogonal to a conveyance direction. Each head 10 includes nozzles 17 from which liquid is discharged. Details of the heads 10 are described below.

The platen 14 is a support component on which the recording medium 12 is placed. The platen 14 is disposed to face a nozzle surface 19 of the head 10 in which the nozzles 17 are open. The conveyance mechanism 15 conveys the recording medium 12. The conveyance mechanism 15 includes four rollers 15*a* and a conveyance motor 15*b* driving the rollers 15*a*. First and second roller pairs are formed by the four rollers 15*a*, and the first roller pair including two of the four rollers 15*a* and the second roller pair including the remaining two rollers 15*a* are arranged with the platen 14 intervening therebetween in the conveyance direction. The two rollers 15*a* in each of the first and second roller pairs are arranged to sandwich the recording medium 12 therebetween, and rotate in mutually opposite directions by the conveyance motor 15*b*. Accordingly, the recording medium 12 is conveyed in the conveyance direction. Of the two rollers 15*a* included in each of the first and second roller pairs, one of the two rollers 15*a* may be coupled to the conveyance motor 15*b* to function as a driving roller, and the other roller may function as a driven roller.

The controller 16 includes an arithmetic section (not depicted) and a storage (not depicted). The arithmetic section includes a processor, and the like. The storage includes a memory that can be accessed from the arithmetic section. The arithmetic section executes a program stored in the storage, thus controlling the head unit 13 and the conveyance mechanism 15 of the liquid discharge apparatus 11.

<Head>

As depicted in FIG. 1, in each head 10, the nozzles 17 form two nozzle rows 18 that extend linearly in a direction (nozzle alignment direction) having a predefined angle θ to the conveyance direction. The two nozzle rows 18 are arranged parallel to each other with an interval in a direction (head-unit extending direction) orthogonal to the alignment direction. In the following, the nozzle alignment direction is simply referred to as an alignment direction, and the head-unit extending direction is simply referred to as an extending direction. The two nozzle rows 18 include the same number of nozzles 17. The angle θ of the alignment direction to the conveyance direction is, for example, in a range of equal to or more than 30° and equal to or less than 60°.

Figure 2:
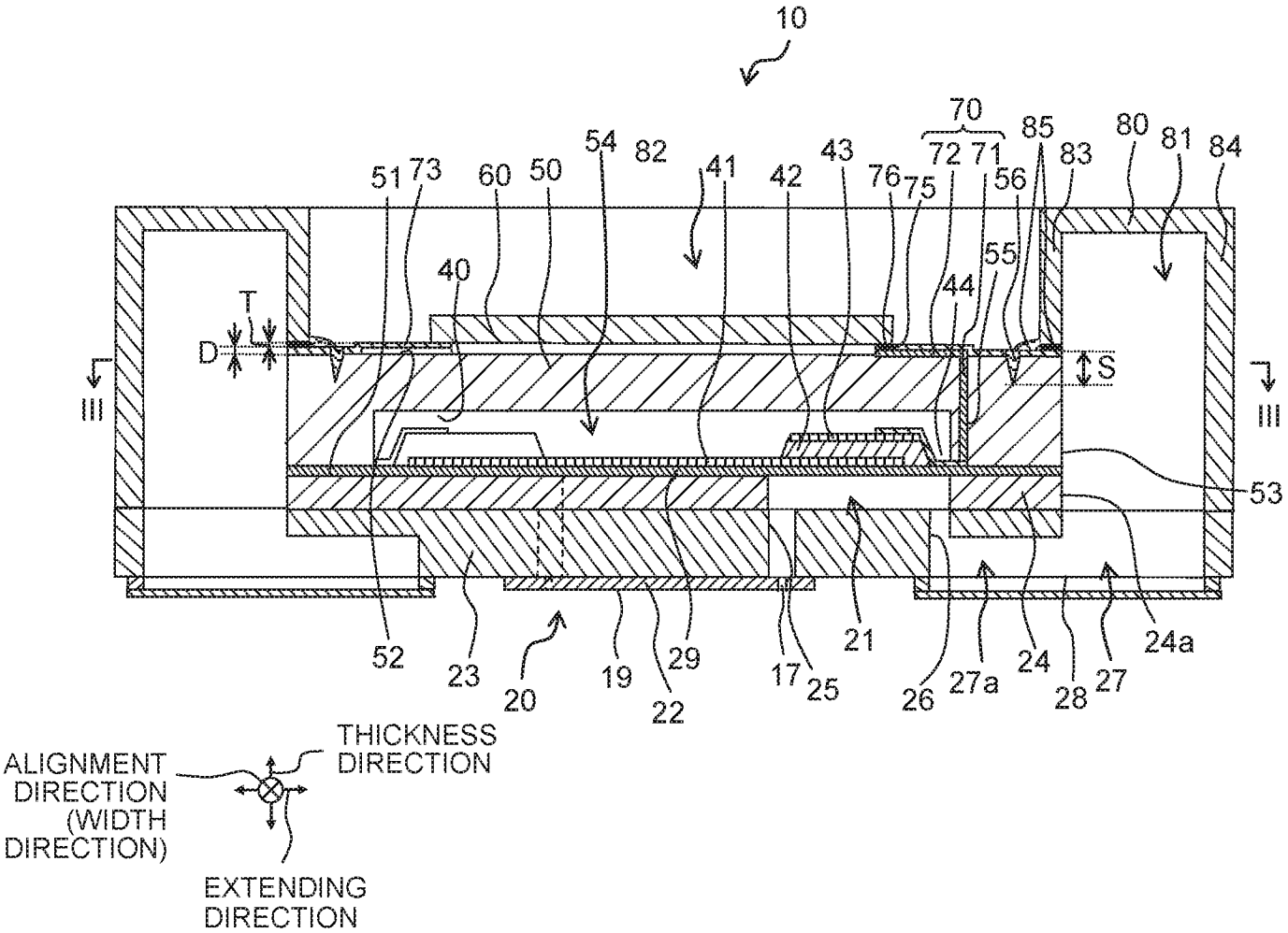
FIG. 2 is a cross-sectional view of the head taken along a line II-II in FIG. 1.
Figure 3:
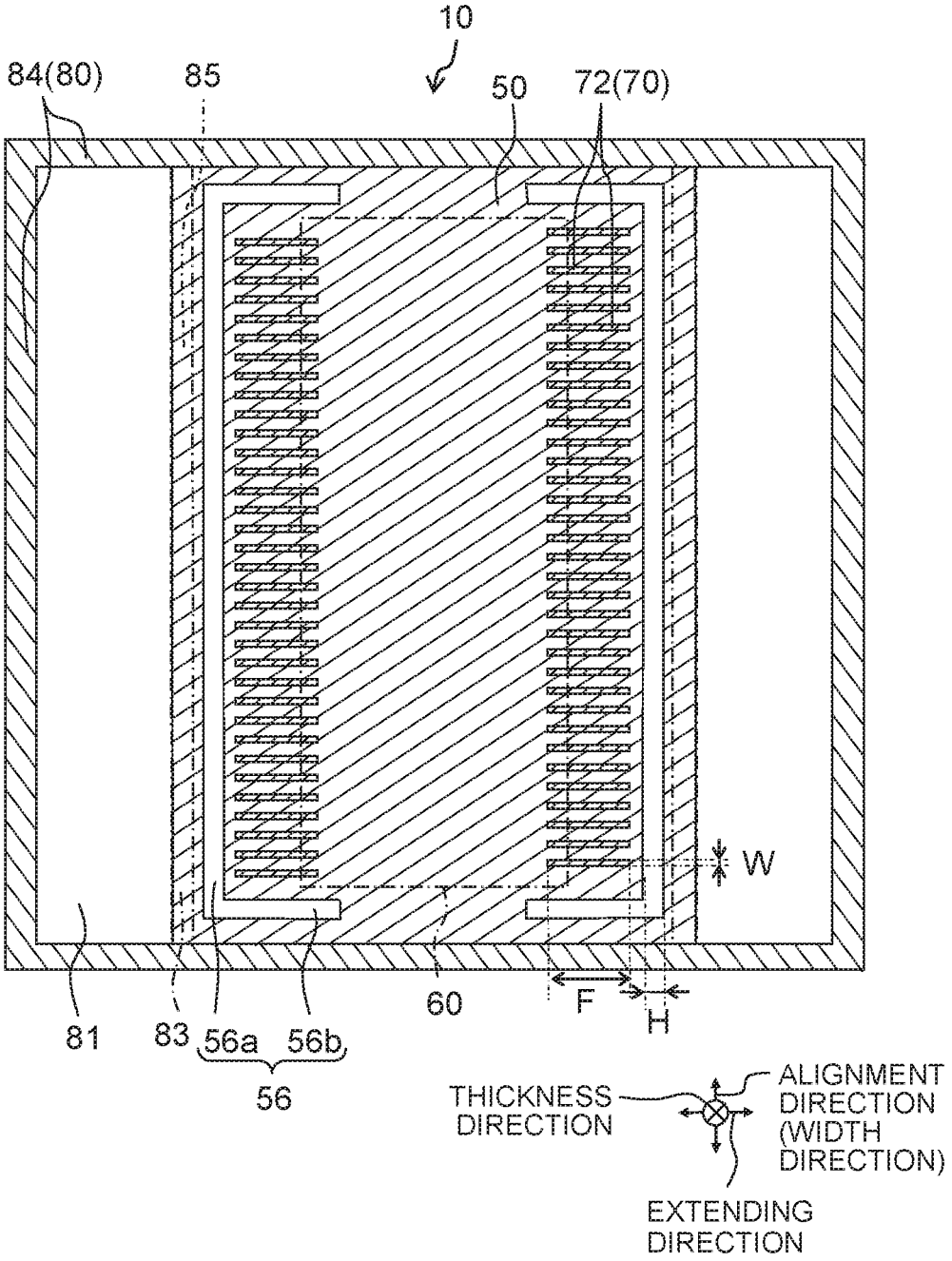
FIG. 3 is a cross-sectional view of a part of the head taken along a line III-III in FIG. 2.

As depicted in FIGS. 2 and 3, each of the heads 10 includes a channel substrate 20, a plurality of piezoelectric elements 40, a support substrate 50, a drive section 60, traces 70, and a reservoir member 80. In the following, the direction directed from the channel substrate 20 to the support substrate 50 is referred to as upward (upper side), and its opposite direction is referred to as downward (lower side). The placement direction of the head 10, however, is not limited thereto.

The channel substrate 20 is a substrate in which a plurality of pressure chambers 21 communicating with the nozzles 17 are formed. The channel substrate 20 includes a nozzle plate 22, a communicating plate 23, and a pressure chamber plate 24 which are stacked on top of each other in that order and are joined with each other with adhesive or the like. The direction (thickness direction) in which the plates are stacked is perpendicular to the alignment direction and the extending direction. Each of the plates has, for example, a flat plate shape. The plates are made using metal material such as stainless steel, silicon, ceramics, synthetic resin material such as polyimide, or the like.

The nozzles 17 are provided in the nozzle plate 22. The nozzles 17 pass through the nozzle plate 22 in the thickness direction. A lower surface of the nozzle plate 22 is the nozzle surface 19 in which the nozzles 17 are open.

The communicating plate 23 includes descenders 25, branched channels 26, and reservoir channels (first reservoir channels 27). In the extending direction, the direction from the branched channel 26 to the descender 25 is referred to as inward (inner side), and its opposite direction is referred to as outward (outer side).

Each descender 25 passes through the communicating plate 23 in the thickness direction and communicates with the corresponding nozzle 17. Each branched channel 26 is branched from the corresponding first reservoir channel 27 to communicate with the pressure chamber 21. The branched channel 26 passes through the communicating plate 23 in the thickness direction and extends from the first reservoir channel 27 to allow the first reservoir channel 27 to communicate with the corresponding pressure chamber 21.

The first reservoir channels 27 are arranged in the alignment direction along the pressure chambers 21. In each first reservoir channel 27, its lower portion extends more inward in the extending direction than its upper portion. The lower portion (in particular, wide portion 27*a*) communicates with the branched channel 26. The wide portion 27*a* of the first reservoir channel 27 is a recess formed in a lower surface of the communicating plate 23. A part of the first reservoir channel 27 positioned outside the wide portion 27*a* passes through the communicating plate 23 in the thickness direction.

A damper film 28 adheres to the lower surface of the communicating plate 23 to cover the first reservoir channels 27. The damper film 28 is a flexible film-shaped member. Deformation of the damper film 28 reduces the pressure change in liquid in the first reservoir channels 27.

The pressure chamber plate 24 has a lower surface on the communicating plate 23 side, an upper surface on the side opposite to the lower surface, and end surfaces 24*a* connecting the lower and upper surfaces. The pressure chamber plate 24 is smaller in size in the extending direction than the communicating plate 23. The communicating plate 23 extends beyond the pressure chamber plate 24 in the extending direction.

The pressure chambers 21 are provided in the pressure chamber plate 24. Each pressure chamber 21 passes through the pressure chamber plate 24 in the thickness direction to communicate with the descender 25 and the branched channel 26. This allows the pressure chamber 21 to communicate with the corresponding nozzle 17 via the descender 25 and to communicate with the first reservoir channel 27 via the branched channel 26.

A vibration plate 29 is placed on the upper surface of the pressure chamber plate 24. The vibration plate 29 covers the pressure chambers 21 in the pressure chamber plate 24. The piezoelectric elements 40 are provided on the vibration plate 29 while corresponding to the pressure chambers 21, and the piezoelectric elements 40 are placed on the pressure chambers 21 via the vibration plate 29. The vibration plate 29 may be formed by a part of the pressure chamber plate 24. In that configuration, the lower surface of the pressure chamber 24 is recessed to form the pressure chambers 21, and a part of the pressure chamber plate 24 positioned on the upper side of the pressure chambers 21 is used as the vibration plate 29.

Each piezoelectric element 40, which includes a common electrode 41, a piezoelectric body 42, and an individual electrode 43, is arranged to overlap with the pressure chamber 21 in the thickness direction. The common electrode 41, which is common to the piezoelectric elements 40, is disposed on the vibration plate 29 to cover an entire upper surface of the vibration plate 29. A common trace (not depicted) is connected to the common electrode 41, and the common trace extends on the upper surface of the vibration plate 29 in a direction orthogonal to the thickness direction. The upper surface of the vibration plate 29 may be covered with an insulating film (not depicted), and the common electrode 41 may be disposed on the upper surface of the vibration plate 29 via the insulating film.

Each of the piezoelectric bodies 42 is disposed on the corresponding one of the pressure chambers 21 via the vibration plate 29 and the common electrode 41. Each of the individual electrodes 43 is disposed on the corresponding one of the piezoelectric bodies 42. Each of individual traces 44 is connected to the corresponding one of the individual electrodes 43. The individual trace 44 extends outward in the extending direction.

Applying voltage to the individual electrode 43 deforms the piezoelectric body 42, thereby displacing the vibration 29. The displacement of the vibration plate 29 toward the pressure chamber 21 side reduces the volume of the pressure chamber 21, applying pressure to the liquid in the pressure chamber 21. This jets the liquid from the nozzle 17 communicating with the pressure chamber 21.

The support substrate 50 is made, for example, by using silicon. The support substrate 50 has a flat plate shape having the same size as the pressure chamber plate 24 and the vibration plate 29. The support substrate 50 has a lower surface 51 on the pressure chamber plate 24 side, an upper surface 52 on the side opposite to the lower surface 51, and end surfaces 53 connecting the lower surface 51 and the upper surface 52.

The support substrate 50 is disposed on the opposite side of the channel substrate 20 with the piezoelectric elements 40 intervening between the support substrate 50 and the channel substrate 20. For example, the support substrate 50 is stacked on the surface (upper surface) on the piezoelectric element 40 side of the pressure chamber plate 24 via the vibration plate 29 such that the end surfaces 53 are flush with the end surfaces 24*a* of the pressure chamber plate 24 in the thickness direction.

The support substrate 50 includes an accommodating portion 54 in which the piezoelectric elements 40 are accommodated. The accommodating portion 54 is a recess formed in the lower surface 51. The piezoelectric elements 40 are arranged in the accommodating portion 54 and the support substrate 50 covers the piezoelectric elements 40. In the support substrate 50, parts of the lower surface 51 positioned between the accommodating part 54 and the end surfaces 53 in the extending direction are joined to the upper surface of the pressure chamber plate 24.

The support substrate 50 has through holes 55 through which the traces 70 pass. The through holes 55 are arranged at intervals in the alignment direction such that the traces 70 passing through the through holes 55 are connected to the individual traces 44 of the piezoelectric elements 40.

Each through hole 55 passes through the support substrate 50 in the thickness direction at a position between the accommodating portion 54 and one of the end surfaces 53 in the extending direction. The through holes 55 are open both in the upper surface 52 and the lower surface 51 of the support substrate 50. The individual traces 44 are arranged to face the openings of the lower surface 51. Namely, each individual trace 44 extends outward, in the extending direction, from a position on the individual electrode 43 of the piezoelectric element 40, passes through between the support substrate 50 and the pressure chamber plate 24, and reaches a lower end of the through hole 55.

The trace 70, which is made by using metal such as copper, has a first portion 71 and a second portion 72. As many traces 70 as the through holes 55 are arranged. The traces 70 connect the piezoelectric elements 40 and the drive section 60. The traces 70 may be subjected to surface treatment such as plating.

The first portion 71, which passes through each through hole 55 of the support substrate 50, extends linearly in the thickness direction between the upper surface 52 and the lower surface 51 of the support substrate 50. A lower end of the first portion 71 reaches the individual trace 44 on the pressure chamber plate 24. In that configuration, the lower end of the first portion 71 can be easily connected to the individual trace 44 in a position between the support substrate 50 and the pressure chamber plate 24 without using a bump electrode or the like for connecting the first portion 71 and the individual trace 44.

The second portion 72 extends linearly in the extending direction on the upper surface 52 of the support substrate 50 between the drive section 60 and the through hole 55. A first end of the second portion 72 is electrically connected to the drive section 60, and a second end of the second portion 72 is connected to an upper end of the first portion 71. In that configuration, the drive section 60 is electrically connected to each individual electrode 43 of the piezoelectric element 40 via the first portion 71, the second portion 72, and the individual trace 44. The traces 70 connected to the individual electrodes 43 are arranged parallel to each other with intervals in the alignment direction.

Similar to each individual electrode 43 of the piezoelectric element 40, the common electrode 41 of the piezoelectric element 40 is electrically connected to the drive section 60 via the trace 70 and the common trace. The second portion 72 of the trace 70 connected to the common electrode 41 may extend on the upper surface 52 of the support substrate 50 in the alignment direction. The second portion 72 of the trace 70 connected to the individual electrode 43 and the common electrode 41 may be embedded in a groove formed in the upper surface 52 of the support substrate 50.

A protective film 73 covering the traces 70 is provided on the upper surface 52 of the support substrate 50. The projection film 73, which is made, for example, by using silicon nitride (SiN), protects the traces 70 from impurities such as moisture and oxygen. The projection film 73 covers not only the traces 70, but also areas of the upper surface 52 of the support substrate 50 where the traces 70 are not formed. The size (thickness T) in the thickness direction of the protective film 73 is, for example, in a range of equal to or more than 0.4 μm and equal to or less than 0.5 μm.

The drive section 60 is, for example, a circuit board on which a driver IC (not depicted) driving the piezoelectric elements 40 is mounted. The driver IC may be a semiconductor chip. The drive section 60 is disposed on the upper surface 52 of the support substrate 50 via the protective film 73. The drive section 60 may be a Chip on Film (COF) on a film-like circuit board.

The reservoir member 80 is made, for example, by using resin. The reservoir member 80, which has a rectangular parallelepiped shape, includes channels (second reservoir channels 81) communicating with the pressure chambers 21 and a hollow portion 82 accommodating the drive section 60. The hollow portion 82 is provided at the center of the reservoir member 80 in the direction perpendicular to the thickness direction. The reservoir member 80 is disposed on the upper surface 52 of the support substrate 50 such that the drive section 60 disposed on the upper surface 52 of the support substrate 50 is placed in the hollow portion 82. In that configuration, the drive section 60 is exposed outside by virtue of the hollow portion 82, making it possible to connect the drive section 60 to an external apparatus, and the like.

The reservoir member 80 includes, for example, two second reservoir channels 81. The two second reservoir channels 81 extend parallel to each other in the alignment direction with the hollow portion 82 intervening therebetween in the extending direction. Each second reservoir channel 81 is a recess formed in the lower surface of the reservoir member 80, and is open in the lower surface of the reservoir 80. The reservoir member 80 is disposed on the communicating plate 23 such that the second reservoir channels 81 overlap with the first reservoir channels 27 of the communicating plate 23 in the thickness direction and communicate therewith. Each second reservoir channel 81 forms, together with the first reservoir channel 27, a supply route through which liquid is supplied to each pressure chamber 21 via the branched channel 26.

The reservoir member 80 includes parts (walls) defining each second reservoir channel 81 which are exemplified by walls extending in the alignment direction and walls extending in the extending direction. The walls extending in the alignment direction are arranged with the second reservoir channel 81 intervening therebetween in the extending direction.

One (inner wall 83), of the walls extending in the alignment direction, disposed on the side closer to the trace 70 than the second reservoir channel 81 is different in size in the thickness direction from the other wall (other wall 84) and the walls extending in the extending direction. The inner wall 83 is shorter than the other wall 84 in the thickness direction. In that configuration, a lower surface of the other wall 84 is joined to an upper surface of the communicating plate 23, and a lower surface of the inner wall 83 is joined to the upper surface 52 of the support substrate 50. The second reservoir channel 81 is thus defined by the end surface 24*a* of the pressure chamber plate 24, the end surface 53 of the support substrate 50, and the walls of the reservoir member 80. Accordingly, the reservoir member 80 and the support substrate 50 define the second reservoir channel 81. Allowing the support substrate 50 to accommodate the piezoelectric elements 40 and to form the second reservoir channels 81 downsizes the liquid discharge apparatus 11.

The lower surface of the inner wall 83 of the reservoir member 80 is joined to the upper surface 52 of the support substrate 50 with an adhesive 85. If an insufficient amount of the adhesive 85 is used for the joining, bonding failure or adhesion failure between the reservoir member 80 and the support substrate 50 may be caused to form a gap. This gap may cause leakage of liquid from the second reservoir channel 81 to the upper surface 52 of the support substrate 50. If an excessive amount of the adhesive 85 is used for the joining, the adhesive 85 may spill out of the joining area between the reservoir member 80 and the support substrate 50, may adhere to the traces 70 on the upper surface 52 of the support substrate 50, and may disconnect or break the traces 70. Recesses 56 are thus provided on the upper surface 52 of the support substrate 50.

Each recess 56 is provided on the upper surface 52 of the support substrate 50 at a position between the traces 70 and the second reservoir channel 81. The recess 56 is formed in the upper surface 52 of the support substrate 50 to extend in the thickness direction. In that configuration, if the adhesive 85 spills out of the joining area between the inner wall 83 of the reservoir member 80 and the support substrate 50 and flows on the support substrate 50, the adhesive 85 flows into the recess 56 and is thus inhibited from adhering to the traces 70. The traces 70 thus do not suffer from stress which may otherwise caused by the difference in linear expansion coefficients between the adhesive 85 and the traces 70. This can inhibit the disconnection of the traces 70 due to the stress.

For example, when the support substrate 50 contains silicon (Si), the linear expansion coefficient of the support substrate 50 is in a range of equal to or more than $3\times10^{-6}$/K and equal to or less than $4\times10^{-6}$/K. When the protective film 73 contains silicon nitride (SiN), the linear expansion coefficient of the protective film 73 is $3\times10^{-6}$/K. When the traces 70 contain copper, the linear expansion coefficient of the traces 70 is $1\times10^{-6}$/K. When the traces 70 contain gold, the linear expansion coefficient of the traces 70 is $14\times10^{-6}$/K. When the adhesive 85 contains epoxy-based resin, the linear expansion coefficient of the adhesive 85 is $62\times10^{-6}$/K.

The adhesive 85 is inhibited from adhering to the traces 70 as described above. The leakage of liquid from the second reservoir channel 81 due to the bonding failure is thus inhibited without unnecessarily reducing the amount of the adhesive 85. Further, the above configuration does not need to separate the joining area from the traces 70 in order to inhibit adhesion of the adhesive 85 to the traces 70, thus downsizing the liquid discharge apparatus 11.

The recess 56 is disposed, for example, between the joining area and the traces 70 in the extending direction. A part of the support substrate 50 between the joining area and the traces 70 is thicker than a part of the support substrate 50 including the accommodating portion 54. In that configuration, forming the recess 56 in the support substrate 50 is not likely to damage or break the support substrate 50.

For example, the cross-section of the recess 56 orthogonal to the alignment direction is a V-shape. This prevents the size (depth) in the thickness direction of the recess 56 from being too large, and the possibility that the support substrate 50 is damaged by the recess 56 is low. For example, when the recess 56 is formed by wet etching, the depth of the recess 56 depends on a crystalline orientation of the support substrate 50. In that case, the depth of the recess 56 can be easily adjusted by reducing an area of an opening corresponding to the recess 56 in a resist process for covering the support substrate 50. Accordingly, the recess 56 is formed without being removed excessively, making it possible to make the depth of the recess 56 small and to prevent the damage in the support substrate 50.

For example, the recess 56 has a ratio (aspect ratio) of a size S in the thickness direction to a size F in the extending direction of equal to or less than 10. Further, for example, the size F in the extending direction of the recess 56 is in a range of equal to or more than 1 μm and equal to or less than 3 μm, and the size S in the thickness direction of the recess 56 is in a range of equal to or more than 10 μm and equal to or less than 30 μm. Making the recess 56 have the above sizes reduces the possibility of damaging the support substrate 50. Further, since the recess 56 keeps or holds the adhesive 85, the adhesive 85 is inhibited from adhering to the traces 70.

As depicted in FIG. 3, each recess 56 is a groove continuously extending in the upper surface 52 of the support substrate 50 along the alignment direction. Since the traces 70 are arranged in the alignment direction, each recess 56 extends continuously in the alignment direction. The recesses 56 can thus inhibit the adhesive 85 from flowing toward the traces 70, making it possible to more reliably inhibit the adhesion of the adhesive 85 to the traces 70. Although the traces 70 are arranged in the alignment direction orthogonal to an extending direction of the traces 70 (extending direction) in this embodiment, the traces 70 may be arranged in a direction intersecting with the extending direction. Also in that case, each recess 56 continuously extends along the direction in which the traces 70 are arranged, making it possible to more reliably inhibit the adhesion of the adhesive 85 to the traces 70.

The recess 56 has a portion extending in the alignment direction (first recess portion 56*a*) and portions extending in the extending direction (second recess portions 56*b*). The first recess portion 56*a* extends, in the alignment direction, beyond the drive section 60 and an arrangement area of the traces 70. The second recess portions 56*b* extend from ends of the first recess portion 56*a* toward the drive section 60 side in the extending direction. The second recess portions 56*b* extend in the extending direction in areas of the upper surface 52 of the support substrate 50 where the drive section 60 and the arrangement area of the traces 70 are not formed.

In the above configuration, almost the entirety of the traces 70 and the drive section 60 is surrounded by the first recess portion 56*a* and the second recess portions 56*b*. The second recess portions 56*b* can thus inhibit the adhesive 85 flowing from the joining area with the reservoir member 80 in the extending direction from entering the drive section 60 and the traces 70. Accordingly, the adhesion of the adhesive 85 to the traces 70 can be inhibited more reliably.

In the above configuration, each recess 56 has the first recess portion 56*a* extending in the alignment direction and the second recess portions 56*b* extending in the extending direction. The recess 56, however, may not have the second recess portions 56*b*, namely, may only have the first recess portion 56*a*. Also in that case, since the first recess portion 56*a* extends, in the alignment direction, beyond the drive section 60 and the arrangement area of the traces 70 or to the same position as the drive section 60 and the arrangement area of the traces 70, the adhesion of the adhesive 85 to the traces 70 can be inhibited.

In the trace 70, the cross-section of the second portion 72 that extends on the upper surface 52 of the support substrate 50 is larger than the cross-section of the first portion 71 that passes through the through hole 55 of the support substrate 50. In that configuration, the second portion 72 is thicker than the first portion 71. The second portion 72 is thus not likely to be disconnected or broken even if the adhesive 85 adheres to the second portion 72.

In the second portion 72, the size (width W) in the width direction (alignment direction) orthogonal to the extending direction is the same as or greater than the size (thickness D) in the thickness direction. For example, in the second portion 72, the width W is in a range of equal to or more than 1 μm and equal to or less than 3 μm, and the thickness D is 1 μm. For example, if the second portion 72 is thick, stress may separate the second portion 72 bonded to the support substrate 50 with the adhesive 85, from the support substrate 50. In this embodiment, however, the width of the second portion 72 is large. It is thus possible to reduce the possibility that the second portion 72 peels from the support substrate 50, even if the adhesive 85 adheres to the second portion 72.

<Method of Producing Head>

Figure 4A:
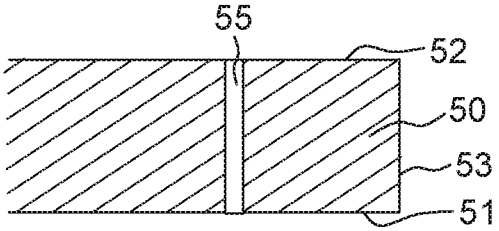
FIGS. 4A to 4F are illustrative views of a method of producing the head depicted in FIG. 1.

As depicted in FIG. 4A, the through hole 55 passing through the support substrate 50 in the thickness direction is formed in a producing method of the head 10. The through hole 55 can be formed, for example, by a variety of processing methods including: etching such as wet etching and dry etching; laser machining; blast machining; ultrasonic machining; and machining or mechanical processing.

Figure 4B:
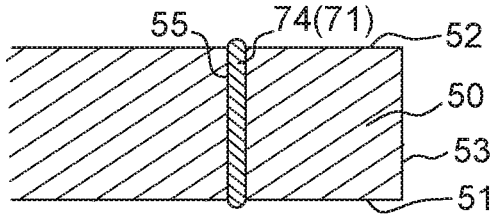
Figure 4C:
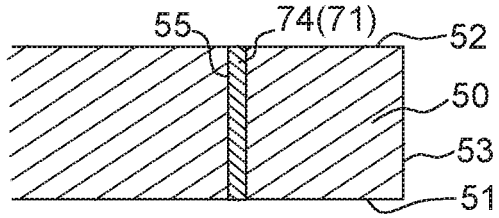

As depicted in FIG. 4B, the through hole 55 is filled with a conductive material (first conductive material 74) such as metal. In that situation, the first conductive material 74 may protrude from the upper surface 52 and the lower surface 51 of the support substrate 50. In that case, depicted in FIG. 4C, the protruding portions of the first conductive material 74 are removed through polishing, grinding, or the like. This prevents adjacent first conductive materials 74 from being electrically connected to each other. Then, the first portion 71 made by using the first conductive material 74 is formed in the through hole 55, the upper end of the first portion 71 is flush with the upper surface 52 of the support substrate 50, and the lower end of the first portion 71 is flush with the lower surface 51 of the support substrate 50.

Figure 4D:
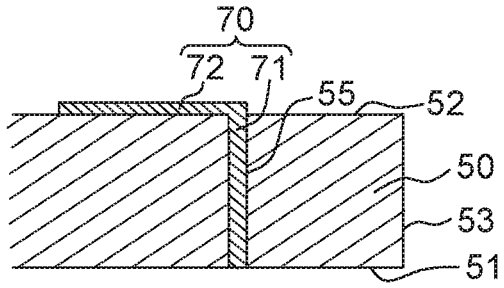

Subsequently, the upper surface 52 of the support substrate 50 is covered with a metal film (not depicted), an area to be left as the second portion 72 is covered with a mask (resist, not depicted), and the metal film covering areas other than the above area is removed. Then, as depicted in FIG. 4D, the metal film remaining on the upper surface 52 of the support substrate 50 is formed as the second portion 72. Here, the second portion 72 connected to the upper end of the first portion 71 extends in the extending direction toward the end surface 53 side of the support substrate 50.

Accordingly, the trace 70 having the first portion 71 and the second portion 72 which are connected with each other is formed. The method of forming the trace 70 is not limited thereto. For example, the first portion 71 and the second portion 72 may be formed at the same time.

Figure 4E:
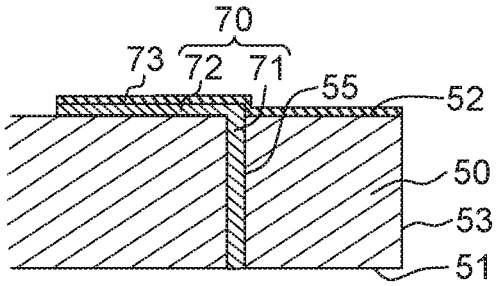

As depicted in FIG. 4E, the protective film 73 is formed on the upper surface 52 of the support substrate 50 provided with the wiling line 70, through sputtering target, a photolithography method, or the like. This allows the trace 70 and the upper surface 52 of the support substrate 50 to be covered with the protective film 73.

Subsequently, areas of the protective film 73 other than an area corresponding to an opening 75 at which the drive section 60 is joined to the support substrate 50 and an area corresponding to the recess 56, are covered with a mask (not depicted). Further, an area of the lower surface 51 of the support substrate 50 other than an area corresponding to the accommodating portion 54 is covered with a mask. The area corresponding to the opening 75 is provided at an area of the protective film 73 covering the second portion 72. The area corresponding to the recess 56 is provided at an area of the protective film 73 between the trace 70 and the end surface 53 of the support substrate 50. The area corresponding to the accommodating portion 54 is provided in the support substrate 50 on the side opposite to the end surface 53 with the through hole 55 intervening between the area and the end surface 53.

Figure 4F:
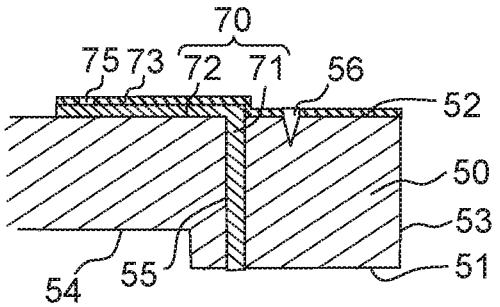

Then, areas of the protective film 73 and the support substrate 50 not covered with the mask are removed by using an etching liquid. The etching process forms the opening 75 passing through the protective film 73, the recess 56 passing through the protective film 73 and recessed from the upper surface 52 of the support substrate 50, and the accommodating portion 54 recessed from the lower surface 51 of the support substrate 50, as depicted in FIG. 4F. Accordingly, the recess 56 can be formed together with the opening 75 and the accommodating portion 54, reducing manufacturing steps and costs.

Inclined surfaces of the accommodating portion 54 and the recess 56 are parallel to the (110) plane or (100) plane that is the crystalline orientation of the support substrate 50. The accommodating portion 54 and the recess 56 can thus be formed at the same time in the wet etching.

The protective film 73 is subjected to overetching, forming the recess 56 in the protective film 73 and the support substrate 50 disposed under the protective film 73. This makes the size of the opening of the recess 56 in the lower surface of the protective film 73 identical to the size of the opening of the recess 56 in the upper surface of the support substrate 50.

As depicted in FIG. 2, the opening 75 is filled with a conductive material (second conductive material 76) such as metal. Since the opening 75 passes through the protective film 73 disposed on the second portion 72, a lower end of the second conductive material 76 passing through the opening 75 is electrically connected to the second portion 72. An upper end of the second conductive material 76 extends to the upper surface of the protective film 73. The drive section 60 is disposed on the protective film 73 so that the upper end of the second conductive material 76 is electrically connected to an electrode of the drive section 60. This allows the second conductive material 76 to electrically connect between the second portion 72 and the drive section 60.

Each piezoelectric element 40 is disposed on the pressure chamber plate 24 via the vibration plate 29. The support substrate 50 is joined to the pressure chamber plate 24 via the vibration plate 29 so that the piezoelectric elements 40 are accommodated in the accommodating portion 54. This allows the lower end of each first portion 71 passing through the through hole 55 of the support substrate 50 to be connected to the corresponding individual trace 44 drawn from the piezoelectric element 40. Then, the communicating plate 23 and the nozzle plate 22 are stacked on the pressure chamber plate 24, forming the channel substrate 20.

The reservoir member 80 is joined to the support substrate 50 and the communicating plate 23 with adhesive so that the inner walls 83 of the reservoir member 80 are positioned on the upper surface 52 of the support substrate 50 via the protective film 73 and other walls of the reservoir member 80 are positioned on the upper surface 52 of the communicating plate 23. Accordingly, the second reservoir channels 81 of the reservoir member 80 are formed by the support substrate 50 and the pressure chamber plate 24.

When the adhesive 85, by which the support substrate 50 is joined to the reservoir member 80, spills out of the joining area, the adhesive 85 flows on the upper surface 52 of the support substrate 50 toward the traces 70. In this embodiment, since the adhesive 85 enters the recess 56 provided between the traces 70 on the upper surface 52 of the support substrate 50 and the second reservoir channel 81 and the adhesive 85 is held in the recess 56, the adhesion of the adhesive 85 to the traces 70 is inhibited.

First Modified Embodiment

Figure 5:
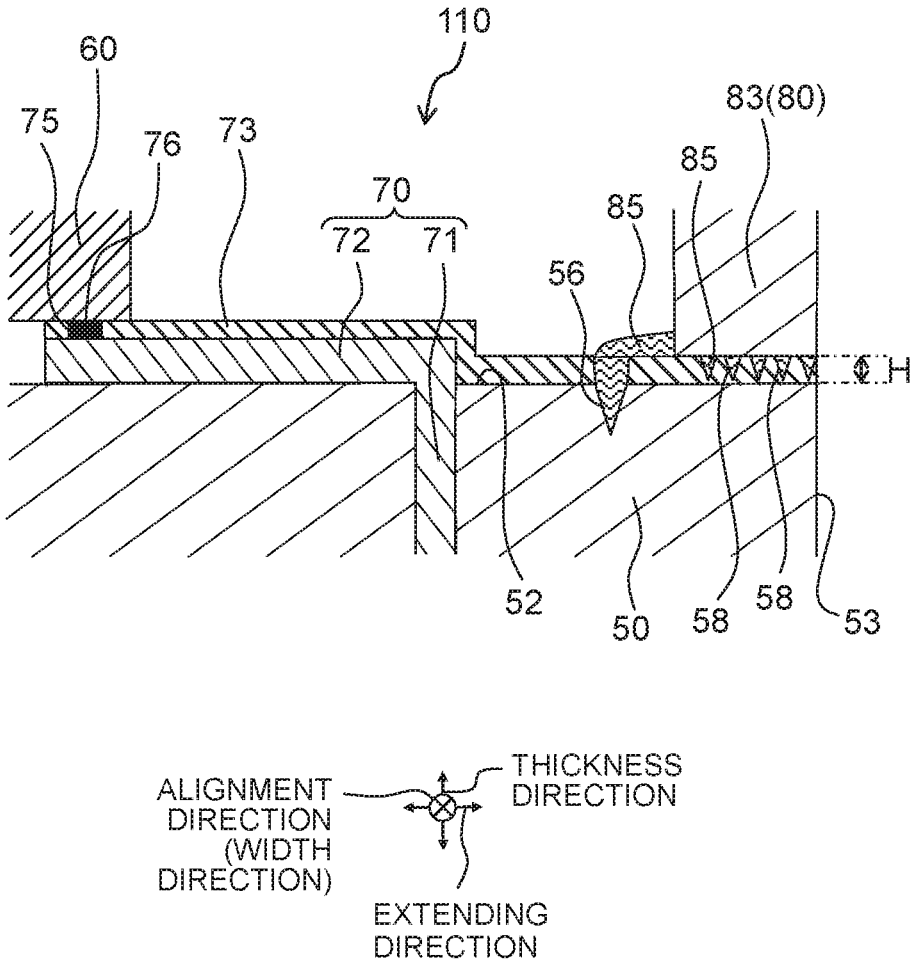
FIG. 5 schematically depicts a part of a head according to the first modified embodiment of the first embodiment.

In a head 110 according to the first modified embodiment of the first embodiment, as depicted in FIG. 5, the protective film 73 may cover the joining area of the support substrate 50 with the reservoir member 80 and depressions 58 may be formed in the joining area of the protective film 73. For example, a size H in the thickness direction of the depression 58 is very small (e.g., equal to or more than 0.4 μm and equal to or less than 0.5 μm), and many depressions 58 are provided in the joining area so that the protective film 73 has a surface roughness Ra of equal to or more than 0.01 μm. The depressions 58 are formed, for example, by patterning or ion milling in which scraping is performed by ion irradiation. The size H in the thickness direction of the depression 58 may be greater than that of the protective film 73 to pass through the protective film 73 and to reach the support substrate 50.

The rough surface of the protective film 73 improves the adhesion strength of the adhesive 85. The amount of the adhesive 85 in the joining area can thus be reduced without reducing the adhesion strength between the support substrate 50 and the reservoir member 80. The amount of the adhesive 85 spilling out of the joining area is thus reduced, making it possible to inhibit the adhesion of the adhesive 85 to the traces 70.

The depression 58 can be formed with the opening 75, the accommodating portion 54, and the recess 56 in the etching process depicted in FIG. 4F. For example, areas of the protective film 73 other than the areas corresponding to the opening 75, the recess 56, and the depression 58 are covered with a mask, and an area of the lower surface 51 of the support substrate 50 other than the area corresponding to the accommodating portion 54 is covered with a mask. Then, areas of the protective film 73 and the support substrate 50 not covered the mask are removed by using an etching liquid. The etching process forms the opening 75, the recess 56, the depression 58, and the accommodating part 54 in the support substrate 50, making it possible to reduce manufacturing steps and costs.

Second Modified Embodiment

Figure 6:
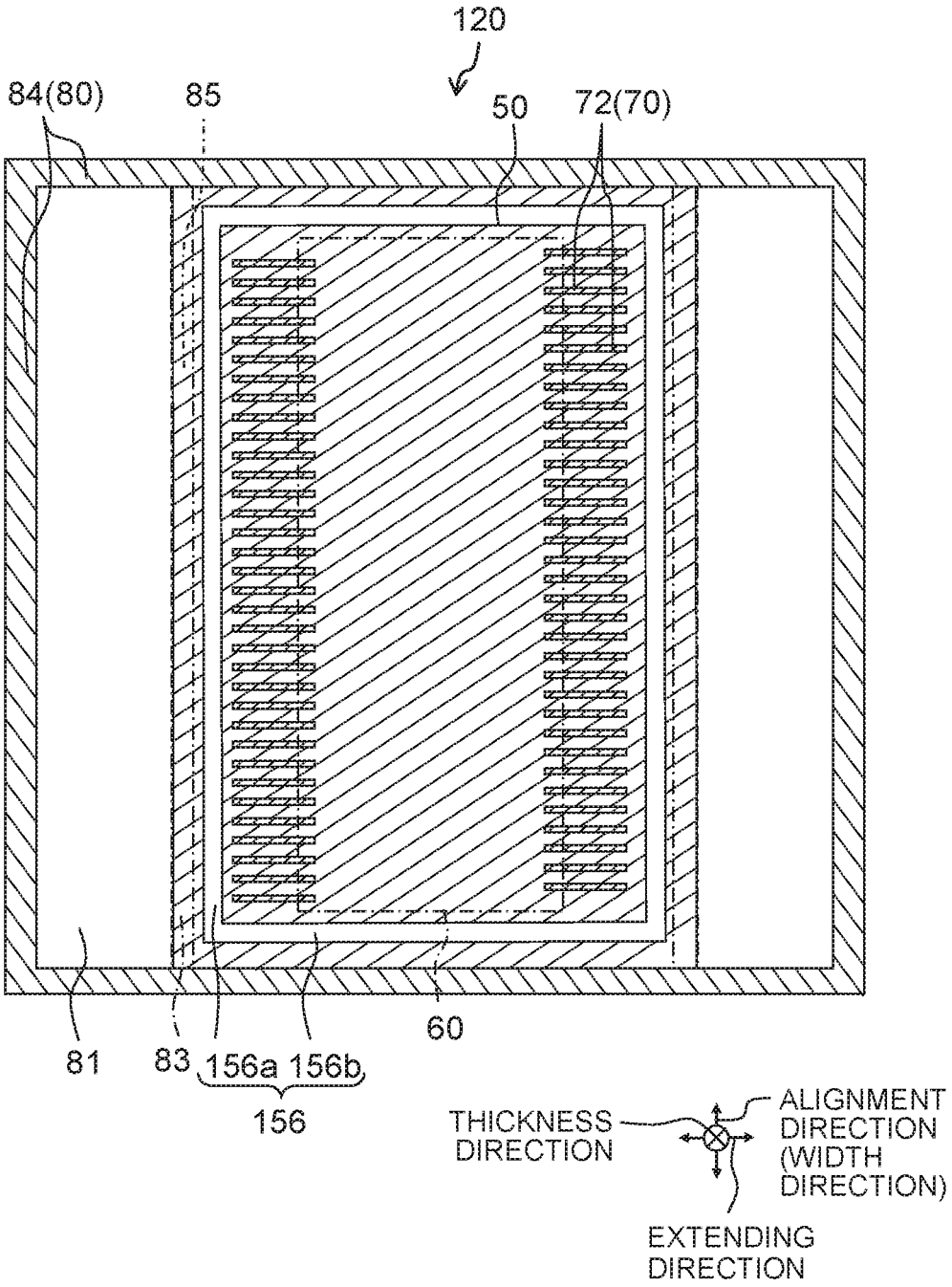
FIG. 6 schematically depicts a part of a head according to the second modified embodiment of the first embodiment.

As depicted in FIG. 6, a head 120 according to the second modified embodiment of the first embodiment may include a recess 156 that continuously surrounds the traces 70. For example, the recess 156 may include first recess portions 156*a* extending in the alignment direction and second recess portions 156*b* extending in the extending direction.

The first recess portions 156*a* are arranged to be parallel to each other with the drive section 60 and the traces 70 intervening therebetween in the extending direction. The second recess portions 156*b* are arranged to be parallel to each other with the drive section 60 and the traces 70 intervening therebetween in the alignment direction. First ends of the first recess portions 156*a* are connected to one of the second recess portions 156*b*, and second ends of the first recess portions 156*a* are connected to the other second recess portion 156*b*. This allows the drive section 60 and the traces 70 to be arranged in an area of support substrate 50 surrounded by the first recess portions 156*a* and the second recess portions 156*b*. In that configuration, the adhesive 85 in the joining area that is positioned outside the surrounded area is reliably inhibited from adhering to the drive section 60 and the traces 70.

In the head 120 according to the second modified embodiment, the depressions 58 as depicted in FIG. 5 may be formed in the joining area of the protective film 73.

Third Modified Embodiment

In a head according to the third modified embodiment of the first embodiment, the size (thickness T) in the thickness direction of the protective film 73 may be greater than a normal size (e.g., equal to or more than 0.4 μm and equal to or less than 0.5 μm). For example, when the size in the thickness direction of the accommodating part 54 and the recess 56 is greater than the size of the opening 75, the time for forming the accommodating part 54 and the recess 56 is longer than the time for forming the opening 75. In that case, when the accommodating portion 54, the opening 75, and the recess 56 are formed in the same step by wet etching, after formation of the opening 75, the etching liquid used for forming the accommodating portion 54 and the recess 56 may remove the traces 70 disposed under the opening 75.

In order to deal with the above problem, the size of the protective film 73 is made to be greater than the normal size. This makes the size in the thickness direction of the opening 75 close to the size of the accommodating portion 54 and the recess 56, and makes the time for forming the opening 75 close to the time for forming the accommodating portion 54 and the recess 56. Accordingly, the traces 70 disposed under the opening 75 are inhibited from being removed. Also in the heads 110 and 120 according to the first and second modified embodiments, the size in the thickness direction of the protective film 73 may be greater than the normal size.

Fourth Modified Embodiment

In a method of producing the head 10 according to the fourth modified embodiment of the first embodiment, after the recess 56 and the accommodating portion 54 are formed in the support substrate 50, the through hole 55 may be formed with the recess 56 intervening between the through hole 55 and the end surface 53 of the support substrate 50. For example, when the recess 56 and the like are formed by etching after the formation of the through hole 55, the through hole 55 is required to be covered with a lid not to allow the resist for etching to enter the through hole 55. The lid can be omitted when the through hole 55 is formed after the formation of the recess 56 and the like. Also in the method of producing each of the heads 10, 110, and 120 according to the first to third modified embodiments, the through hole 55 may be formed after the formation of the recess 56 and the like.

Fifth Modified Embodiment

In a method of producing the head 10 according to the fifth modified embodiment of the first embodiment, the opening 75 may be formed independently of the accommodating portion 54 and the recess 56. In that case, even if the size in the thickness direction of the accommodating part 54 and the recess 56 is larger than the size of the opening 75, the etching liquid used for forming the accommodating portion 54 and the recess 56 does not remove the traces 70 disposed under the opening 75. Also in the method of producing each of the heads 10, 110, and 120 according to the first to fourth modified embodiments, the through hole 55 may be formed after the formation of the recess 56 and the like.

Second Embodiment

Figure 7:
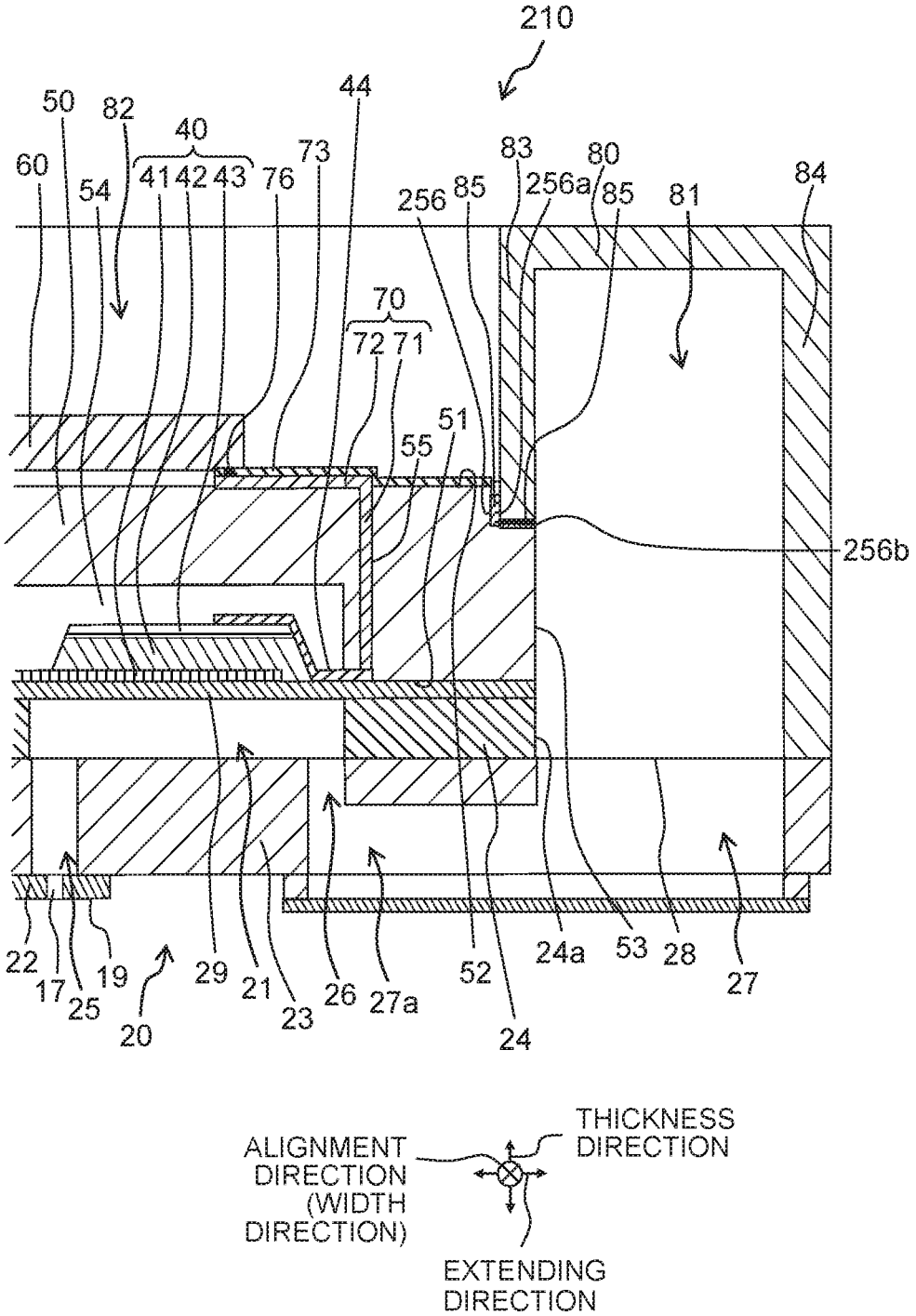
FIG. 7 schematically depicts a part of a head according to the second embodiment.

As depicted in FIG. 7, in a head 210 according to the second embodiment, the position and shape of a recess 256 are different from those of the recess 56 of the head 10 depicted in FIG. 2. Any other configurations than the above are the same as those of the head 10 depicted in FIG. 2 according to the first embodiment, the explanation therefor is omitted.

The recess 256 is formed on the upper surface 52 of the support substrate 50 at a position between the traces 70 and the second reservoir channel 81 to include the joining area with the reservoir member 80. In the support substrate 50, the recess 256 is defined by an end surface 256*a* that is perpendicular to the extending direction, an upper surface 256*b* that is perpendicular to the thickness direction, and an end surface (not depicted) that is perpendicular to the alignment direction.

The end surface 256*a* is recessed, in the extending direction, from the end surface 53 toward the accommodating portion 54 and the through hole 55. The end surface 256*a* is flat, and is parallel to an area of the end surface 53 of the support substrate 50 other than the recess 256. The upper surface 256*b* is recessed downward, in the thickness direction, from the upper surface 52 toward the channel substrate 20. The upper surface 256*b* is flat, and is parallel to an area of the upper surface 52 of the support substrate 50 other than the recess 256.

The size in the extending direction of the recess 256 is the same as or larger than the size of the inner wall 83 of the reservoir member 80, allowing the inner wall 83 to be fitted into the recess 256. A lower end surface of the inner wall 83 is joined to the upper surface 256*b* of the recess 256 by the adhesive 85 so that the surface of the inner wall 83 on the second reservoir channel 81 side is flush with the end surface 53 of the support substrate 50.

In the support substrate 50, the upper surface 256*b* is positioned below an area of the upper surface 52 not including the upper surface 256*b*, and there is a height difference in the thickness direction between the upper surface 256*b* and the upper surface 52. This height difference inhibits the adhesive 85 spilling out of the joining area between the inner wall 83 and the upper surface 256*b*, from flowing toward the wiling lines 70 disposed on the upper surface 52. Accordingly, it is possible to inhibit the adhesion of the adhesive 85 to the traces 70 and the disconnection of the traces 70 due to the adhesive 85.

When the size in the extending direction of the upper surface 256*b* is greater than the size in the extending direction of the lower end surface of the inner wall 83, a gap is present between the end surface 256*a* of the recess 256 and the inner wall 83. In this configuration, the adhesive 85 spilling out of the joining area enters the gap, which inhibits the adhesive 85 from flowing toward the traces 70 disposed on the upper surface 52. Accordingly, it is possible to inhibit the adhesion of the adhesive 85 to the traces 70 and the disconnection of the traces 70 due to the adhesive 85.

The adhesion of the adhesive 85 to the traces 70 is inhibited as described above. This makes it possible to inhibit the liquid leakage from the second reservoir channel 81 due to the adhesion failure without excessively reducing the amount of the adhesive 85. Further, the joining area is not required to be provided away from the traces 70 in order to inhibit the adhesion of the adhesive 85 to the traces 70, thus downsizing the liquid discharge apparatus 11.

The method of producing the head 210 according to the second embodiment is the same as the method of producing the head 210 depicted in FIGS. 4A to 4F, except for the position and shape of the recess 256. Thus, when the accommodating portion 54 is formed on the lower surface 51 side of the support substrate 50 by etching, the recess 256 is formed in the upper surface 52 of the support substrate 50 at a position between the traces 70 and the second reservoir channel 81. Accordingly, the recess 256 can be formed together with the accommodating portion 54, making it possible to reduce manufacturing steps and costs.

In the head 210 according to the second embodiment, the recess 256 may be provided to continuously surround the traces 70 and the drive section 60, similar to the second modified embodiment depicted in FIG. 6. This reliably inhibits the adhesion of the adhesive 85 to the drive section 60 and the traces 70. In the head 210, the size in the thickness direction of the protective film 73 may be greater than the normal size, similar to the third modified embodiment. In the method of producing the head 210, the through hole 55 may be formed after the recess 256 and the accommodating portion 56 are formed, similar to the fourth modified embodiment. In the method of producing the head 210, the opening 75 may be formed independently of the accommodating portion 54 and the recess 256, similar to the fifth modified embodiment.

Third Embodiment

Figure 8:
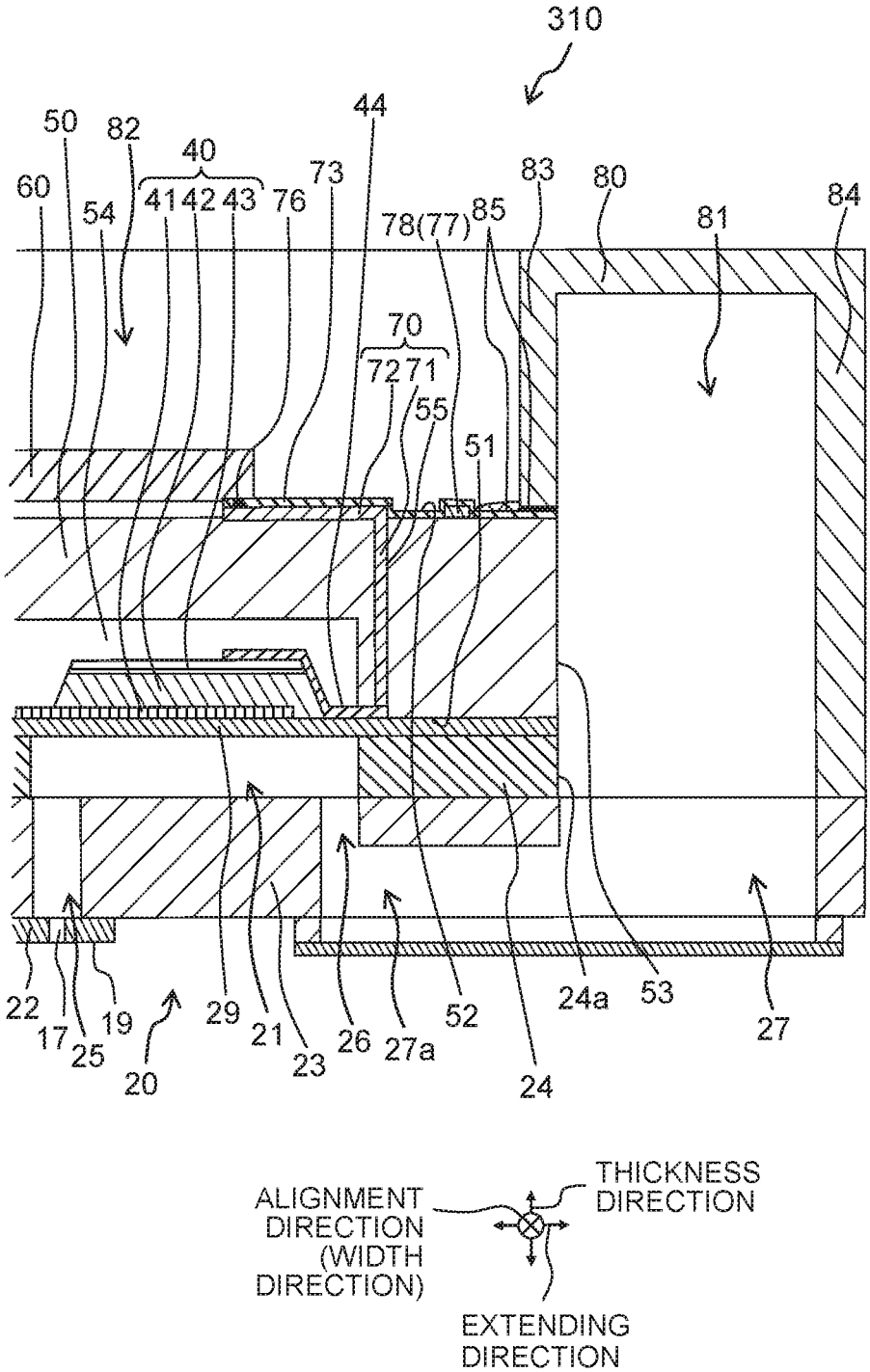
FIG. 8 schematically depicts a part of a head according to the third embodiment.

As depicted in FIG. 8, in a head 310 according to the third embodiment, a protrusion 77 is provided on the upper surface 52 of the support substrate 50 at a position between the wiling lines 70 and the second reservoir channel 81, instead of the recess 56 depicted in FIG. 2. Any other configurations than the above are the same as those of the head 10 according to the first embodiment, the explanation therefor is omitted.

For example, the protrusion 77 protrudes in the thickness direction from the upper surface 52 of the support substrate 50 at a position between the traces 70 and the inner wall 83 of the reservoir member 80. The protrusion 77 is made by using the same material as the traces 70. The protrusion 77 thus inhibits the adhesive 85 spilling out of the joining area between the inner wall 83 and the support substrate 50 from flowing toward the traces 70, thereby inhibiting the adhesion of the adhesive 85 to the traces 70 and the disconnection of the traces 70 due to the adhesive 85.

For example, the cross-section of the protrusion 77 orthogonal to the alignment direction is rectangular. In that configuration, a surface of the protrusion 77 on the joining area side is perpendicular to the upper surface 52 of the support substrate 50 and extends from the upper surface 52 in the thickness direction. The adhesive 85 is thus not likely to spill out of the recess 256, thereby inhibiting the adhesion of the adhesive 85 to the traces 70 and the disconnection of the traces 70 due to the adhesive 85.

The adhesion of the adhesive 85 to the traces 70 is inhibited as described above. It is thus possible to inhibit the liquid leakage from the second reservoir channel 81 due to the adhesion failure without excessively reducing the amount of the adhesive 85. Further, the joining area is not required to be provided away from the traces 70 in order to inhibit the adhesion of the adhesive 85 to the traces 70, thus downsizing the liquid discharge apparatus 11.

The protrusion 77 does not affect the thickness of the support substrate 50. This inhibits the protrusion 77 from damaging or breaking the support substrate 50.

The protrusion 77 continuously extends on the upper surface 52 of the support substrate 50 in the alignment direction. Ends in the alignment direction of the protrusion 77 are bent to extend toward the drives section 60 in the extending direction. This allows the protrusion 77 to reliably inhibit the adhesion of the adhesive 85 to the traces 70.

<Method of Producing Head>

Figure 9A:
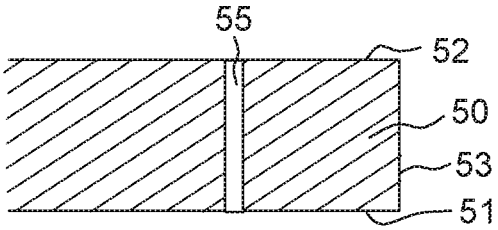
FIGS. 9A to 9F are illustrative views of a method of producing the head depicted in FIG. 8.
Figure 9B:
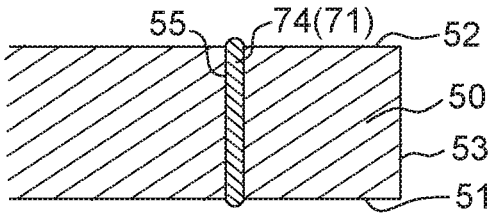
Figure 9C:
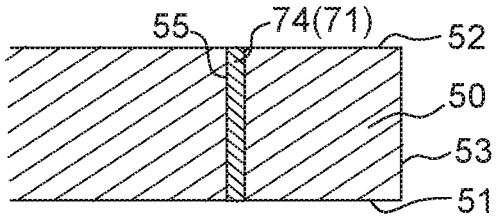
Figure 9D:
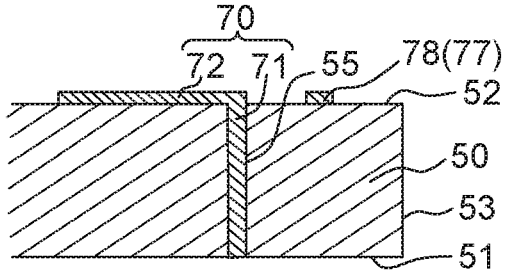
Figure 9E:
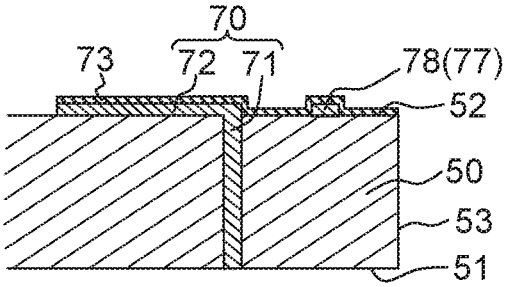
Figure 9F:
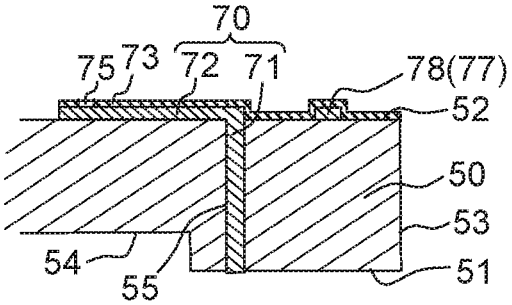

In a method of producing the head 310 according to the third embodiment, processes depicted in FIG. 9A to 9F are executed. In this producing method, processes depicted in FIGS. 9D and 9F are executed instead of the processes depicted in FIG. 4D and FIG. 4F that are included in the producing method of the head 10 according to the first embodiment. The processes depicted in FIGS. 9A to 9C and FIG. 9E are the same as the processes depicted in FIGS. 4A to 4C and FIG. 4E.

Specifically, as depicted in FIG. 9A, the through hole 55 passing through the support substrate 50 in the thickness direction is formed. Then, as depicted in FIGS. 9B to 9D, the trace 70 is formed to pass through the through hole 55 and extend on a surface of the support substrate 50 in a direction intersecting with the thickness direction. In the formation of the trace 70, a dummy trace 78 is formed on the upper surface 52 of the support substrate 50 in an area from the trace 70 to the second reservoir channel 81.

Namely, the upper surface 52 of the support substrate 50 is covered with a metal film (not depicted) and areas to be left as the second portion 72 and the dummy trace 78 are covered with a mask (not depicted), and the metal film covering any other area(s) than the areas covered with the mask is removed. Then, as depicted in FIG. 9D, the metal film left on the upper surface 52 of the support substrate 50 is formed as the second traces portion 72 and the dummy trace 78. Accordingly, the dummy trace 78, which is made by using the same material as the second trace portion 72, is formed as the protrusion 77 at the time of formation of the second trace portion 72, making it possible to reduce manufacturing steps and costs.

As depicted in FIG. 9E, the protective film 73 is formed on the upper surface 52 of the support substrate 50 provided with the trace 70 and the protrusion 77. As depicted in FIG. 9F, an area, of the protective film 73 covering the trace 70, other than an area corresponding to the opening 75 is covered with a mask, and an area of the lower surface 51 of the support substrate 50 other than an area corresponding to the accommodating portion 54 is covered with a mask. Then, areas of the protective film 73 and the support substrate 50 not covered with the mask are removed with the etching liquid. This etching forms the opening 75 in the protective film 73 and forms the accommodating portion 54 in the support substrate 50.

Then, as depicted in FIG. 8, the opening 75 is filled with the second conductive material 76, and the drive section 60 is disposed on the protective film 73 to connect the trace 70 and the drive section 60 via the second conductive material 76. The piezoelectric elements 40 are disposed on the pressure chamber plate 24 via the vibration plate 29, and the support substrate 50 is joined to the pressure chamber plate 24 via the vibration plate 29 so that the piezoelectric elements 40 are accommodated in the accommodating portion 54. Then, the communicating plate 23 and the nozzle plate 22 are stacked on the pressure chamber plate 24, forming the channel substrate 20. The reservoir member 80 is joined to the support substrate 50 and the communicating plate 23 with adhesive. When the adhesive 85 spills out of the joining area, the protrusion 77 inhibits the flow of the adhesive 85 and thus inhibits the adhesion of the adhesive 85 to the traces 70.

Figure 10:
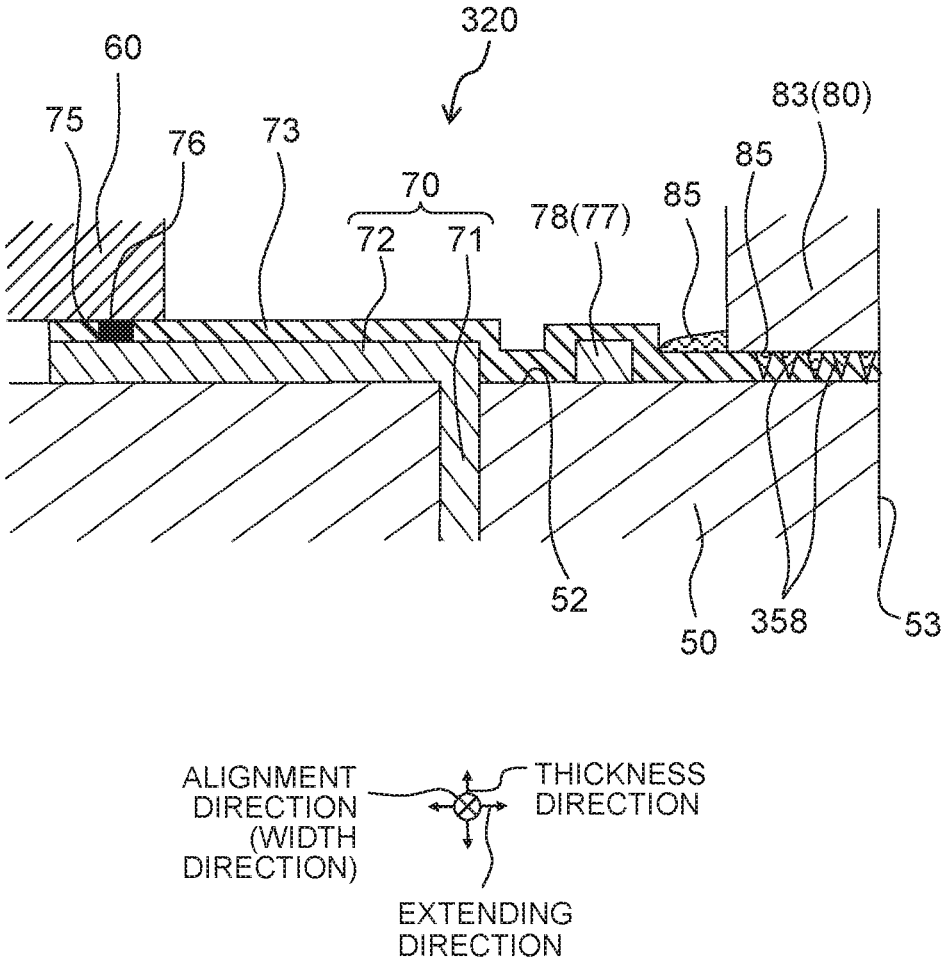
FIG. 10 schematically depicts a part of a head according to a modified embodiment of the third embodiment.

In a head 320 according to a modified embodiment of the third embodiment, as depicted in FIG. 10, the protective film 73 may cover the joining area between the support substrate 50 and the reservoir member 80 and the protective film 73 in joining area may have depressions 358.

The depressions 358 improve the adhesion strength of the adhesive 85 in the joining area, similar to the depressions 58 according to the first modified embodiment depicted in FIG. 5. It is thus possible to reduce the amount of the adhesive 85 in the joining area and to inhibit the adhesion of the adhesive 85 to the traces 70 without reducing the adhesion strength between the support substrate 50 and the reservoir member 80. Further, the depressions 358 can be formed together with the opening 75 and the accommodating portion 54 in the etching process depicted in FIG. 9F, thus reducing manufacturing steps and costs.

In the head 310 according to the third embodiment and the head 320 according to the modified embodiment of the third embodiment, the protrusion 77 may continuously surround the traces 70 and the drive section 60, similar to the second modified embodiment depicted in FIG. 6. This can reliably inhibit the adhesive 85 from adhering to the drive section 60 and the traces 70.

In the head 310 according to the third embodiment and the head 320 according to the modified embodiment of the third embodiment, the size in the thickness direction of the protective film 73 may be greater than the normal size, similar to the third modified embodiment. In each of the methods of producing one of the heads 310 and 320, the through hole 55 may be formed after the formation of the accommodating portion 54, similar to the fourth modified embodiment. In each of the methods of producing one of the heads 310 and 320, the opening 75 may be formed independently of the accommodating portion 54, similar to the fifth modified embodiment.

In the head 310 according to the third embodiment and the head 320 according to the modified embodiment of the third embodiment, the recess 256 depicted in FIG. 7 may be provided, together with the protrusion 77, on the upper surface 52 of the support substrate 50 at a position between the traces 70 and the second reservoir channel 81. Using the recess 256 and the protrusion 77 inhibits the adhesion of the adhesive 85 to the traces 70 more reliably.

Each embodiment and each modified embodiment may be combined provided that no contradiction or exclusion is caused. The above explanation should be interpreted only as examples. It is possible to substantially change details of the configuration and/or the function in the above embodiments and modified embodiments without departing from the spirit and/or gist of the present disclosure.

The head of the present disclosure is useful as a head that can inhibit disconnection of traces, and the like.

What is claimed is:

1. A liquid discharge head, comprising:

a channel substrate including a pressure chamber;

a support substrate including a through hole;

a piezoelectric element disposed between the channel substrate and the support substrate in a thickness direction of the channel substrate to overlap with the pressure chamber in the thickness direction;

a trace connected to the piezoelectric element, passing through the through hole of the support substrate, and extending on the support substrate; and a reservoir member including a channel which communicates with the pressure chamber, and joined to a surface of the support substrate with adhesive, wherein one of a protrusion and a recess is provided on the surface of the support substrate at a position between the trace and the channel.

2. The liquid discharge head according to claim 1, wherein the reservoir member includes a wall defining the channel, the wall includes a portion disposed at a position closer to the trace than the channel, and the portion is joined to the surface of the support substrate with adhesive to define the channel together with the support substrate.

3. The liquid discharge head according to claim 1, wherein the recess is formed in the support substrate at a position between a joining area with the reservoir member and the trace.

4. The liquid discharge head according to claim 3, wherein the recess has a cross section of a V-shape.

5. The liquid discharge head according to claim 1, wherein the protrusion is provided in the support substrate at a position between a joining area with the reservoir member and the trace and is made by using a material identical to that of the trace.

6. The liquid discharge head according to claim 1, further comprising a protective film covering the trace on the support substrate.

7. The liquid discharge head according to claim 6, wherein the protective film further covers a joining area with the reservoir member in the support substrate, and a depression is formed at a part of the support substrate where the protective film covers the joining area.

8. The liquid discharge head according to claim 1, wherein the recess is formed to include a joining area with the reservoir member in the support substrate.

9. The liquid discharge head according to claim 1, wherein the trace is one of a plurality of traces arranged on the support substrate in a direction intersecting with an extending direction of the trace, and one of the protrusion and the recess continuously extends along an arrangement direction of the plurality of traces.

10. The liquid discharge head according to claim 9, wherein one of the protrusion and the recess is provided to surround the plurality of traces.

11. The liquid discharge head according to claim 1, wherein a part of the trace extending on the support substrate has a cross-section which is larger than a cross-section of a part of the trace passing through the through hole.

12. The liquid discharge head according to claim 11, wherein the part of the trace extending on the support substrate has a size in a width direction orthogonal to an extending direction of the trace which is greater than a size in a thickness direction perpendicular to the extending direction and the width direction.

* * * * *